United States Patent [19]

Schoepf

[11] Patent Number: 4,778,402

[45] Date of Patent: Oct. 18, 1988

[54] THERMOS FLASK PRESSURE HOUSING

[75] Inventor: Victor L. Schoepf, Carrollton, Tex.

[73] Assignee: Mobil Oil Corporation, New York, N.Y.

[21] Appl. No.: 106,929

[22] Filed: Oct. 7, 1987

Related U.S. Application Data

[63] Continuation of Ser. No. 830,786, Feb. 19, 1986, abandoned.

[51] Int. Cl.[4] ..... H01R 4/70

[52] U.S. Cl. ..... 439/194; 439/519

[58] Field of Search ..... 439/41, 190, 191, 194, 439/207, 519

[56] References Cited

U.S. PATENT DOCUMENTS

| | | | |
|---|---|---|---|
| 3,471,826 | 10/1969 | Hutter et al. | 339/117 R |
| 4,522,234 | 6/1985 | Kellner et al. | 439/194 |
| 4,589,717 | 5/1986 | Pottier et al. | 339/117 P |
| 4,660,910 | 4/1987 | Sharp et al. | 439/194 |

*Primary Examiner*—J. Patrick McQuade

*Attorney, Agent, or Firm*—Alexander J. McKillop; Michael G. Gilman; George W. Hager, Jr.

[57] ABSTRACT

In a well logging system that is subjected to high temperatures and pressures, an improved thermos flask pressure housing is used to insulate sensitive electronic circuits to the detrimental effects of high temperature and extreme pressure. An evacuated area between an inner shell and an outer shell acts as insulation between electronic circuits within such inner shell and the borehole environment surrounding such outer shell.

1 Claim, 2 Drawing Sheets

THERMOS FLASK PRESSURE HOUSING

This is a continuation of copending application Ser. No. 830,786, filed on Feb. 19, 1986, and now abandoned.

BACKGROUND OF THE INVENTION

The present invention pertains to well logging tools and, more particularly, well logging tool housings that are subjected to wide variations in temperature and pressure.

In present oil production, oil wells may be as deep as 18,000 feet. Some well logs are run in the oil well borehole to determine the location or depth of oil-containing formations. Gamma ray logs, resistivity logs, acoustic logs, etc., are run to determine qualities other than oil location, such as porosity, permeability and other facets of subsurface formations.

A well logging tool may be used in an oil well borehole at depths greater than 15,000 feet. At great depths, the borehole temperature may reach 200° C. and a pressure of up to 20,000 psi.

The extreme pressures and temperatures cause electronic circuits used in well logging operations to operate inaccurately. The temperature condition alone cannot only cause inaccurate operation, but also cause complete failure to operate.

As a result of extreme temperature conditions, a thermos-type of insulated housing has been designed to protect internal components from the destructive effects of high temperatures. However, once the housing is wired, changing connections or replacing internal electronic boards becomes very difficult because the wires connect to the electronic boards inside the housing.

SUMMARY OF THE INVENTION

An improved thermos flask pressure housing is disclosed for use in a hydrocarbon well borehole where temperature and pressure conditions are extreme. An evacuated area between an inner shell and an outer shell acts as insulation between electronic circuits within such inner shell and the borehole environment surrounding such outer shell.

DESCRIPTION OF THE PREFERRED EMBODIMENT

The present invention provides an apparatus for protecting sensitive electronic circuits within a thermos-type flask for providing easy-make/easy-break connections between the electronic circuit contained within and outside wires which carry electrical signals to and from the surface.

Figure 1:
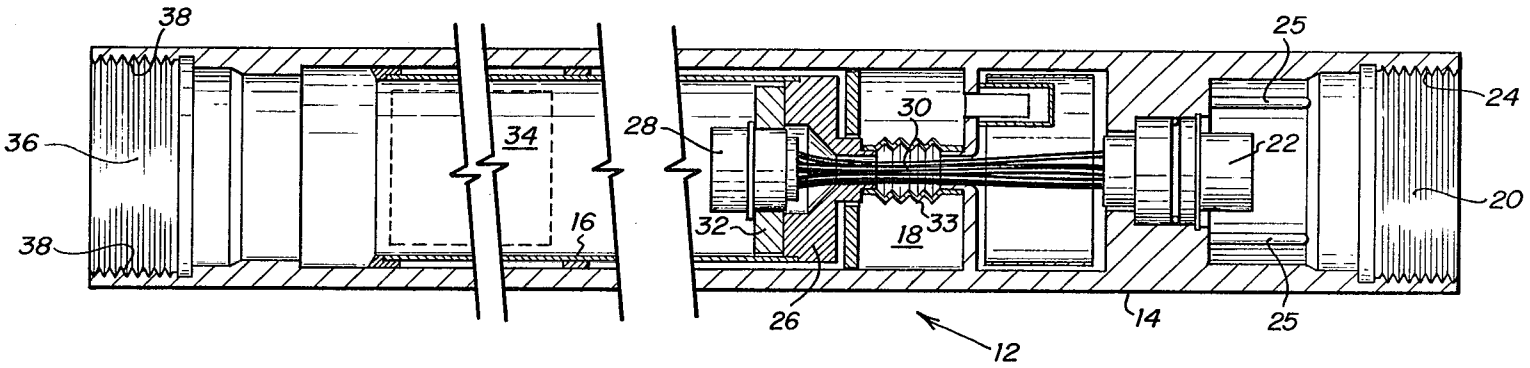
FIG. 1 is a sectional view of a housing for a well logging tool.

Referring now to FIG. 1, a housing 12 is illustrated as having a generally cylindrically shaped outer shell 14, and a generally cylindrically shaped inner shell 16. The central axis of the cylinder defined by outer shell 14 is concentric with the central axis of the cylinder defined by inner shell 16. Between outer shell 14 and inner shell 16 is an evacuated area 17 which acts as insulation between outer shell 14 and inner shell 16.

Outer shell 14 is preferably approximately 0.313-inch thick, made of 17-4 pH hardness steel. Inner shell 16 is approximately 1/16-inch thick stainless steel. The diameter of outer shell 14 is approximately 3.875 inches; however, any outer dimension may be used as long as it fits within the wellbore of a hydrocarbon well within which it will be used.

At the end of outer shell 14 is an area 20 which has a Gearhart connector 22 fixed to the end of outer shell 14 within area 20. Side walls 24 of area 20 are threaded to receive couplers which are described in conjunction with FIG. 3. Pins 25 extend out from a shell 14 to align additional sections which couple to area 20.

At the end of inner shell 16 on stainless steel base 26 is a connector 28 which is connected to connector 22 through wires 30. At the base of connector 28 is an aluminum block 32 which is fastened to stainless steel base 26. A metal bellows 33 isolates wires 30 from evacuated area 18. This is done to maintain the integrity of evacuated area 18. An area 34 within inner shell 16 is an area in which electronic circuits may be placed and be protected from the temperature and pressure rigors of a wellbore within which housing 12 will be used. At the top end of outer shell 14 is an area 36 having threaded edges 38 to receive a coupler described in conjunction with FIG. 3.

Figure 2:
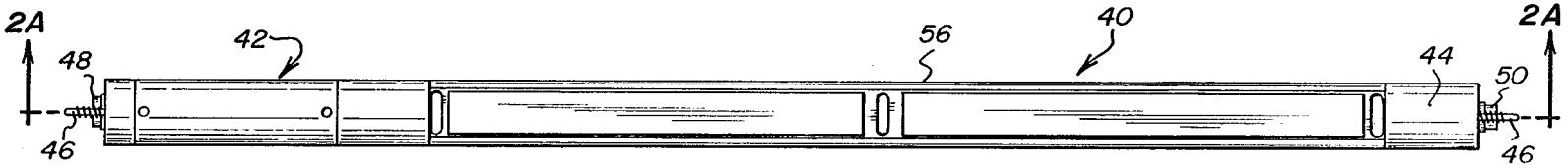
FIG. 2 is a top view of an electronics section which may be placed within the housing of FIG. 1.
Figure 2A:
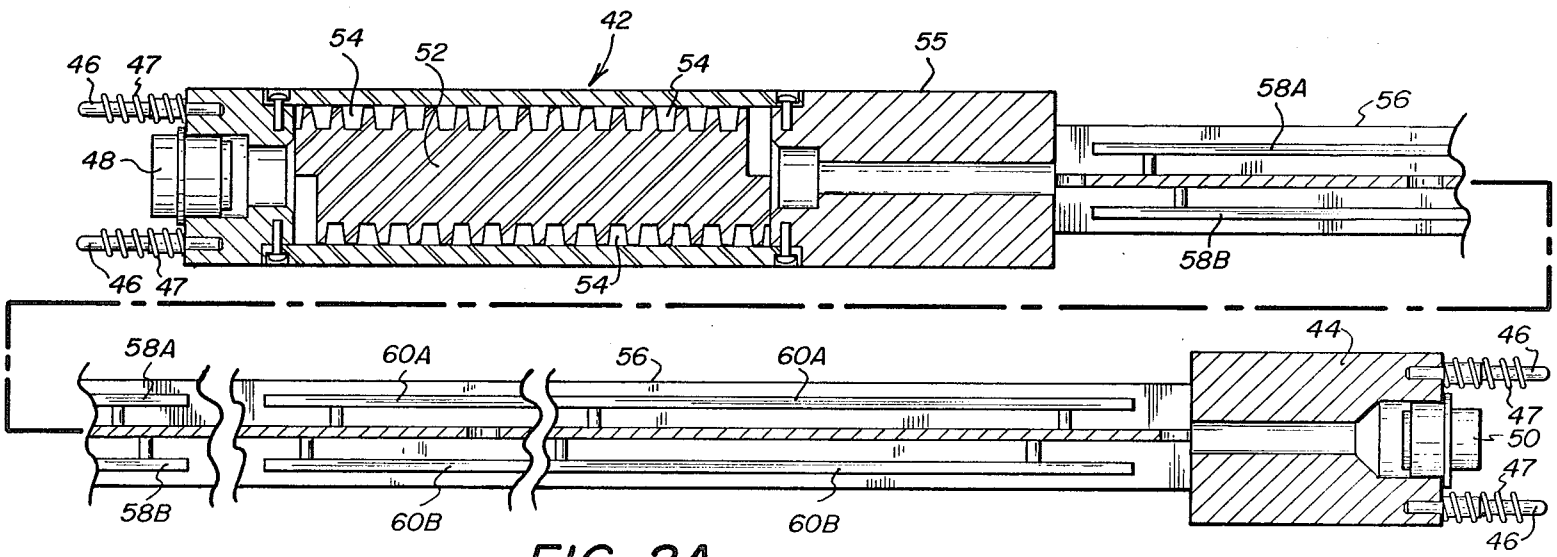
FIG. 2A is a side sectional view taken along lines A—A of FIG. 2.

Referring now to FIG. 2, the top view of electronics section 40 is illustrated as having ends 42 and 44, each having guide pins 46 with spring 47 associated therewith. Ends 42 and 44 have connectors 48 and 50, respectively. End 42 acts as a heat sink to further prevent outside ambient temperature from affecting electronics mounted on section 40. Top end 42 has a Teflon plug 52 having a spiral groove 54 cut therearound. By providing a spiral groove in which wire connections are run to the electronic circuit boards 58A, 58B, 60A and 60B, heat may be dissipated which normally would be carried to the circuit boards through the wires connected to outside ambience. By providing the spiral, the wire lengths are increased from approximately 8 inches, the length of Teflon plug 52, to approximately 5 feet, the length of spiral groove 54. Connected between ends 42 and 44 is body 56 on which circuit boards 58A, 58B, 60A and 60B are mounted. Body 56, along with ends 42 and 44, is preferably cast aluminum to reduce the overall weight of the logging tool system.

Figure 3:
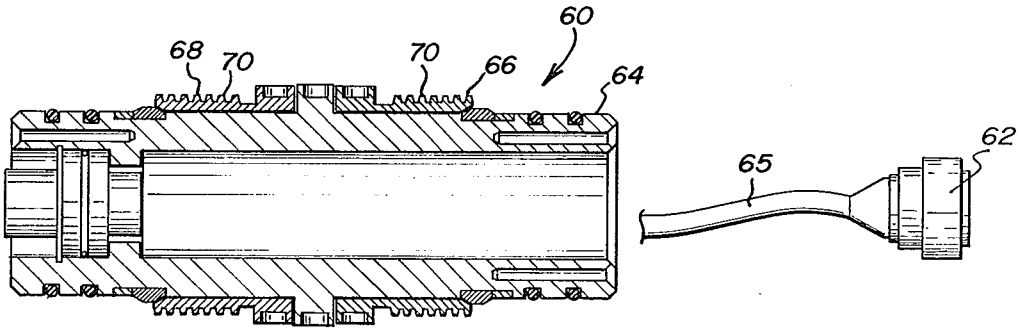
FIG. 3 is a side view of a coupler used with the housing of FIG. 1.

Connector 50 may be adapted to plug into connector 28 of FIG. 1 while connector 48 may be adapted to plug into the coupler 60 described in conjunction with FIG. 3.

Referring now to FIG. 3, a coupler 60 is illustrated as having a connector 62 at one end connected to an insulating plug 64 through wires 65. Adjacent to insulating plug 64 are rotating collars 66 and 68, rotating collar 66 being adapted to fit into area 36 of outer shell 14 with threads 70 matching up with threads 38.

The improved thermos flask housing illustrated in conjunction with FIGS. 1, 2, 2A and 3 provides a housing which protects sensitive electronic circuits from outside temperature and pressure extremes while allowing an easy insertion or retrieval from within the housing by providing connector plugs. The connector plugs are hard-wired to each other to bridge an evacuated area which acts as an insulation between the inner electronics area and the borehole ambience.

While the present invention has been illustrated by way of preferred embodiment, it is to be understood that it is not limited thereto, but only by the scope of the following claims.

I claim:

1. In a well logging system for operation in an oil well borehole, an improved housing for use therewith comprising:

a generally cylindrical-shaped outer shell with a central axis having an outside diameter less than the diameter of said borehole:

a generally cylindrical-shaped inner shell for housing temperature and pressure sensitive electronic circuits having a central axis concentric with the central axis of said generally cylindrical-shaped outer shell and having an outside diameter that is less than the inside diameter of said outer shell so as to provide a first evacuated area between said outer shell and said inner shell which acts as thermal insulation between said outer shell and said inner shell;

a first sealed connector fixed within said inner shell;

a second sealed connector fixed within said outer shell; and means located within said evacuated area for providing a thermally insulated electrical connection between said first connector and said second connector.

* * * * *